US008820023B2

(12) United States Patent
Nam et al.

(10) Patent No.: US 8,820,023 B2
(45) Date of Patent: Sep. 2, 2014

(54) BLOCK DECK USING CONCRETE

(75) Inventors: Kyung-Gu Nam, Daejeon (KR); Dong-Jin Kim, Daejeon (KR); Jung-Il Son, Yongin-si (KR)

(73) Assignee: LG Hausys, Ltd., Seoul (KR)

( * ) Notice: Subject to any disclaimer, the term of this patent is extended or adjusted under 35 U.S.C. 154(b) by 0 days.

(21) Appl. No.: 13/641,816

(22) PCT Filed: Apr. 25, 2011

(86) PCT No.: PCT/KR2011/002978

§ 371 (c)(1),
(2), (4) Date: Oct. 17, 2012

(87) PCT Pub. No.: WO2011/136515

PCT Pub. Date: Nov. 3, 2011

(65) Prior Publication Data

US 2013/0031861 A1 Feb. 7, 2013

(30) Foreign Application Priority Data

Apr. 29, 2010 (KR) ..... 10-2010-0040349

(51) Int. Cl.

| | |
|---|---|
| ***E04C 2/04*** | (2006.01) |
| ***E04C 1/41*** | (2006.01) |
| ***E04B 2/14*** | (2006.01) |
| ***E04C 1/40*** | (2006.01) |

(52) U.S. Cl.

CPC ... *E04C 1/41* (2013.01); *E04B 2/14* (2013.01); *E04C 1/40* (2013.01)

USPC ..... 52/603; 52/604; 52/309.17

(58) Field of Classification Search

CPC ..... E04C 2/28

USPC ..... 52/596, 603, 604, 506.01, 506.06, 52/311.1, 314, 316, 34, 35, 284, 366, 569, 52/570, 571, 572, 606, 607, 561, 309.17; 405/286

See application file for complete search history.

(56) References Cited

U.S. PATENT DOCUMENTS 4,129,960 A * 12/1978 Gale ..... 446/128
4,698,949 A * 10/1987 Dietrich ..... 52/415

(Continued)

FOREIGN PATENT DOCUMENTS

CN 101270602 A 9/2008
CN 101555719 A 10/2009

(Continued)

OTHER PUBLICATIONS

International Search Report mailed Dec. 22, 2011 for PCT/KR2011/002978.

(Continued)

*Primary Examiner* — William Gilbert
*Assistant Examiner* — Kyle Walraed-Sullivan
(74) *Attorney, Agent, or Firm* — Lowe Hauptman & Ham, LLP

(57) ABSTRACT

The present invention relates to a block deck used as the interior or exterior material of a building. More specifically, disclosed is a block deck using concrete, wherein a hollow portion is formed inside and filled with concrete so as to exhibit superior strength. The present invention provides a block deck including: a frame member formed with a hollow portion inside; and filler formed of a concrete material so as to be filled in the hollow portion. At this time, the concrete may be foamed according to desired strength with a foaming rate in the range of 0-50%. The frame member may be formed of natural wood, synthetic wood and synthetic resin materials. And, the frame member may be formed integrally or divisionally into two or more so as to be coupled, wherein coupling is carried out by being fitted in a sliding manner.

10 Claims, 4 Drawing Sheets

(56) References Cited

U.S. PATENT DOCUMENTS

| | | | | |
|---|---|---|---|---|
| 4,922,678 | A * | 5/1990 | Scheiwiller | 52/570 |
| 5,546,721 | A * | 8/1996 | Daniells | 52/606 |
| 7,445,840 | B2 * | 11/2008 | Moriya et al. | 428/319.3 |
| 7,775,747 | B2 * | 8/2010 | Bott | 405/286 |
| 7,963,727 | B1 * | 6/2011 | Wauhop | 405/286 |
| 2005/0210812 | A1 * | 9/2005 | Mountjoy | 52/596 |
| 2007/0193183 | A1 * | 8/2007 | Price et al. | 52/596 |
| 2008/0047219 | A1 * | 2/2008 | Donohew | 52/603 |
| 2008/0148676 | A1 * | 6/2008 | Azar | 52/604 |
| 2009/0000234 | A1 * | 1/2009 | Bott et al. | 52/604 |
| 2009/0025333 | A1 * | 1/2009 | Moroschan | 52/742.13 |
| 2010/0111615 | A1 * | 5/2010 | Bott | 405/286 |

FOREIGN PATENT DOCUMENTS

| | | | |
|---|---|---|---|
| DE | 19542133 | A1 | 5/1996 |
| EP | 0146529 | A2 | 6/1985 |
| JP | 61-95818 | | 6/1986 |
| JP | 8-209853 | | 8/1996 |
| JP | 09003806 | A | 1/1997 |
| JP | 2004068582 | A | 3/2004 |
| KR | 10-2001-0003718 | | 1/2001 |
| KR | 10-2005-0033131 | | 4/2005 |
| KR | 10-2006-0056007 | | 5/2006 |
| KR | 10-0944453 | | 3/2010 |
| WO | WO 2008066499 | A1 * | 6/2008 |

OTHER PUBLICATIONS

ESR from European patent office dated Nov. 25, 2013.
Japanese Office Action dated Dec. 17, 2013.
Chinese Office Action dated Jun. 4, 2014.

* cited by examiner

BLOCK DECK USING CONCRETE

CROSS REFERENCE TO RELATED APPLICATION

This application claims the priority of Korean Patent Application No. 10-2010-0040349, filed on Apr. 29, 2010 in the KIPO (Korean Intellectual Property Office). Further, this application is the National Phase application of International Application No. PCT/KR2011/002978 filed Apr. 25, 2011, which designates the United States and was published in Korean.

TECHNICAL FIELD

The present invention relates to a block deck used as an interior or exterior material for buildings, and more particularly, to a block deck wherein a hollow portion is formed therein and filled with concrete to provide excellent strength and the concrete is foamed to achieve weight reduction.

BACKGROUND ART

In general, natural stone, artificial stone, natural wood, synthetic wood, etc. are used as finishing materials of buildings.

Basically, finishing materials are required to have an aesthetically pleasing appearance, good strength, light weight, and the like.

Since the finishing materials directly or indirectly contact a user's body, quality of the finishing materials such as texture or visual appearance is very important.

Natural stone, artificial stone, and the like have advantages, such as a smooth surface and scratch resistance due to high hardness, but also have disadvantages, such as high price, cold surface to touch, and low impact resistance.

Natural wood, synthetic wood, and the like have been widely used as internal finishing materials for buildings due to advantages, such as warm surface to touch and pleasing outer appearance. However, excessive use of wood materials is not preferable in view of the global environment, and wood materials are expensive.

DISCLOSURE

Technical Problem

The present invention is aimed at providing a block deck for internal and external building materials, which has a pleasing outer appearance and a light weight.

Also, the present invention is aimed at providing a block deck which has good strength and can lead to cost reduction.

Technical Solution

In accordance with one aspect of the present invention, a block deck includes: a frame member having a hollow portion therein; and a filler made of concrete and filling the hollow portion.

The concrete may have a foaming rate of 0~50%.

The frame member may be comprised of one material selected from among natural wood, synthetic wood, and synthetic resin.

The frame member may be formed as a unitary body, or may be divided into two or more members to be assembled. Here, the frame member may be assembled by slide fitting.

To enhance adhesion between the filler and the frame member, the frame member may include a plurality of projections protruding towards the hollow portion.

In accordance with another aspect of the present invention, a block deck includes: a frame member having a hollow portion therein; an external sheet made of natural wood or synthetic wood to be attached to one side of the frame member; and a filler made of concrete and filling the hollow portion.

The concrete may have a foaming rate of 0~50%.

The frame member may be comprised of one material selected from among natural wood, synthetic wood and synthetic resin, and the frame member may include a plurality of projections protruding towards the hollow portion.

Advantageous Effects

The block deck according to the present invention has an outer appearance of wood or synthetic wood and is filled with concrete to have excellent strength.

The block deck according to the present invention is filled with foamed concrete having lower price than wood, thereby reducing manufacturing costs.

BEST MODE

Figure 1:
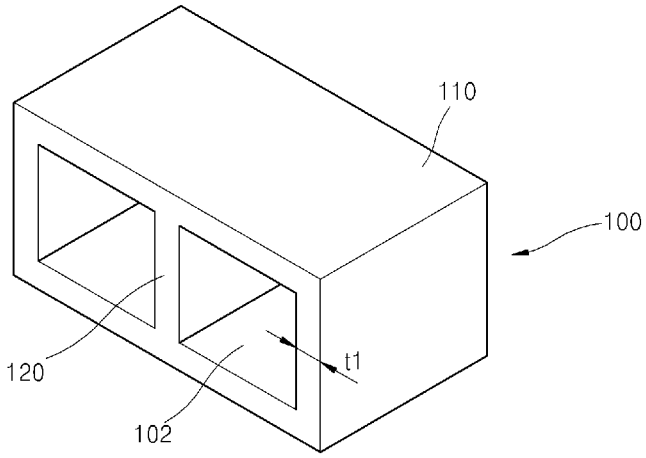
FIG. 1 is a perspective view of a frame member of a block deck according to a first embodiment of the present invention.

Hereinafter, a block deck using foamed concrete according to embodiments of the present invention will be described with reference to the accompanying drawings.

The above and other aspects, features, and advantages of the invention will become apparent from the detailed description of the following embodiments in conjunction with the accompanying drawings. It should be understood that the present invention is not limited to the following embodiments and may be embodied in different ways, and that the embodiments are given to provide complete disclosure of the invention and to provide a thorough understanding of the invention to those skilled in the art. The scope of the invention is defined only by the claims. Like components will be denoted by like reference numerals throughout the specification.

In the drawings, the sizes and relative sizes of elements may be exaggerated for clarity. Further, it will be understood that when a certain element is referred to as being "present inside" or "connected to" another element, the certain element can adjoin the other element or can be separated from the other element. When the element is separated from the other element, it should be understood that an intervening element can also be present to secure or connect the certain element to the other element even if there is no description thereof in the specification.

Figure 2:
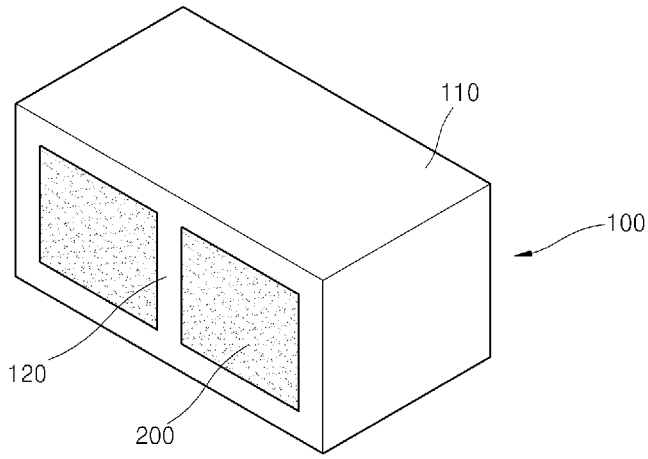
FIG. 2 is a perspective view of the block deck according to the first embodiment of the present invention, in which the frame member is filled with a filler.

FIG. 1 is a perspective view of a frame member of a block deck according to a first embodiment of the present invention, and FIG. 2 is a perspective view of the block deck according to the first embodiment of the present invention, in which the frame member is filled with a filler.

As shown in these figures, a block deck according to the first embodiment includes a frame member 100 having an external decorative surface on one side thereof and a hollow portion 102 therein, and a filler 200 with which the hollow portion 102 is filled.

The external decorative surface 110 of the frame member 100 is exposed upon placement of the block deck, and may have a smooth surface or be formed with an embossed or engraved pattern.

In the block deck according to the first embodiment, the external decorative surface 110 and the frame member 100 are formed as a unitary body, in which the entirety of the frame member 100 is made of a single material. The frame member 100 may be comprised of synthetic wood, natural wood, a synthetic resin, or the like.

Here, synthetic wood may be selected from among boards that are manufactured by mixing and melting general plastic materials, such as polyolefin, polypropylene, acrylonitrile butadiene styrene (ABS), polyvinyl chloride (PVC), etc., and natural materials, such as wood flour, rice husks, and the like, at high temperature, followed by extruding the molten mixture.

When using such synthetic wood to manufacture the frame member 100, a mould is provided to have a moulding space corresponding to the shape of the frame member 100, and the synthetic wood is subjected to pressing or injection molding using the mould to form the frame member 100.

When using natural wood to manufacture the frame member 100, the wood is cut or bonded in the form of the frame member 100.

The synthetic resin may include at least one synthetic resin selected from among polyvinylchloride, polyethylene, polypropylene, polyester, unsaturated polyester, polyamide, polystyrene, polyurethane, polycarbonate, ABS, and polylactic acid.

When using the synthetic resin to manufacture the frame member, the frame member is continuously manufactured by pressing and then cut to a desired length.

In this embodiment, the external decorative surface 110 and the frame member 100 are formed as a unitary body. However, the present invention is not limited thereto. Alternatively, the external decorative surface 110 may be provided as a separate material and then attached to the frame member 100. In particular, when the frame member 100 is made of a synthetic resin, an external sheet separately made of natural wood or synthetic wood may be attached to the frame member 100 to form the external decorative surface 110.

The frame member 100 may be formed therein with a partition wall 120 which partitions the hollow portion. When the block deck has a wide width, a plurality of partition walls 120 may be formed to partition the hollow portion 102 into a plurality of hollow portions.

The hollow portion 102 of the frame member 100 is filled with the filler 200. Here, the filler 200 may be foamed concrete. Since the filler 200 is not exposed to the outside, foamed concrete that is inexpensive and has good strength is used as the filler 200.

The foamed concrete is a plate-shaped concrete material prepared by mixing aluminium powder or the like with concrete to generate foaming bubbles. The foamed concrete has a sufficiently low density that it will float in water and exhibits excellent adiabatic and soundproof properties.

The foamed concrete may have a foaming rate of 0~50%. The foaming rate affects the strength and weight of the foamed concrete. A foaming rate of 0% indicates general concrete. As the foaming rate increases, the total weight of the concrete decreases but the strength thereof is lowered. Therefore, the foamed concrete may have a foaming rate of 50% or less. If the foaming rate exceeds 50%, the foamed concrete cannot have desired strength.

Further, the frame member may have a thickness t ranging from 4 mm to 8 mm If the thickness of the frame member is less than 4 mm, the frame member is likely to be damaged due to low strength. If the thickness of the frame member is greater than 8 mm, there is no effect of reducing the amount of wood used. If the thickness of the frame member ranges from 4 mm to 8 mm, the frame member can provide the texture of wood. Therefore, the frame member need not to be thicker than 8 mm.

Figure 3:
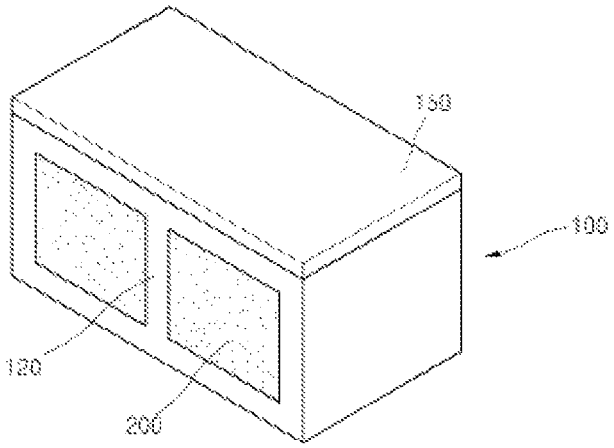
FIG. 3 is a perspective view of a block deck according to a second embodiment of the present invention.

FIG. 3 is a perspective view of a block deck according to a second embodiment of the present invention.

According to the second embodiment shown in FIG. 3, an external sheet is separately provided and attached to the frame member.

As shown therein, the external sheet 150 is provided as a separate member and attached to one side of the frame member 100. In this embodiment, the frame member 100 is not exposed to the outside and thus made of a synthetic resin, and only the external sheet 150 may be made of natural wood or synthetic resin and attached to the frame member 100.

When the external sheet 150 is separately provided and attached to the frame member, the number of manufacturing steps increases, but the use of wood can be decreased because a wood material is used only for a part substantially exposed to the outside.

Figure 4:
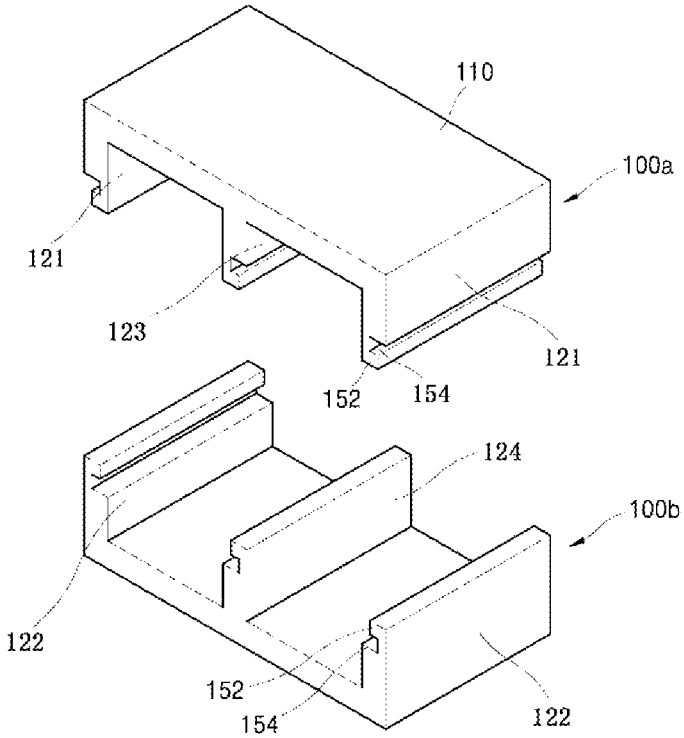
FIG. 4 is an exploded perspective view of a frame member of a block deck according to a third embodiment of the present invention.
Figure 5:
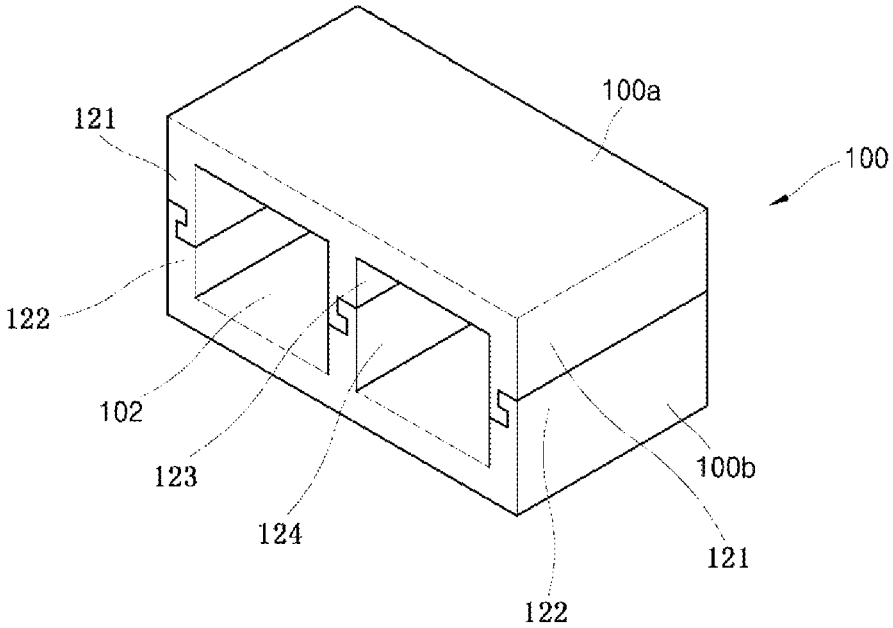
FIG. 5 is a perspective view of the frame member of the block deck according to the third embodiment of the present invention.

FIG. 4 is an exploded perspective view of a frame member of a block deck according to a third embodiment of the present invention, and FIG. 5 is a perspective view of the frame member of the block deck according to the third embodiment of the present invention.

In this embodiment, the frame member 100 is divided into an upper frame member **100*a* including an external surface, and a lower frame member 100*b* including other parts, which are assembled into a single frame member 100**.

At this time, the upper frame member **100*a* and the lower frame member 100*b*** are assembled by slide fitting, so that they can be easily assembled without separate adhesives or the like.

As shown therein, the upper frame member **100*a* is formed with a fitting projection 152 and a fitting groove 154 in each of first side walls 121 and a first partition wall 123, and the lower frame member 100*b* is formed with a fitting projection 152 and a fitting groove 154 in each of second side walls 122 and a second partition wall 124, such that the walls of the upper frame member and the walls of the lower frame can be fitted to each other. The upper and lower frame members 100*a*, 100*b* are more firmly assembled into a single frame member, as the fitting projection 152 and the fitting groove 154 engage with each other and the interiors of the upper and lower frame members are filled with a filler 200**.

Figure 6:
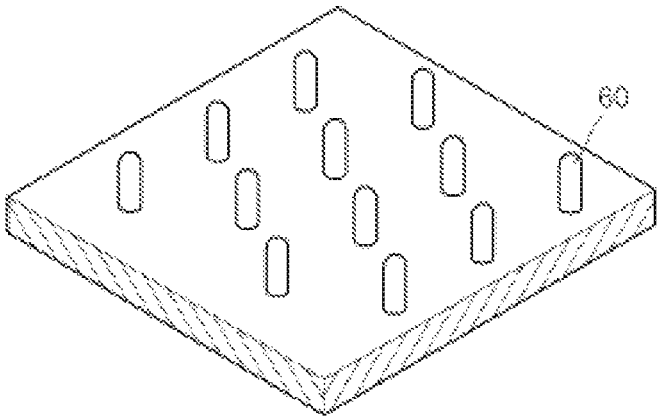
FIGS. 6 and 7 are partially enlarged perspective views of a frame member of block decks according to embodiments of the present invention.
Figure 7:
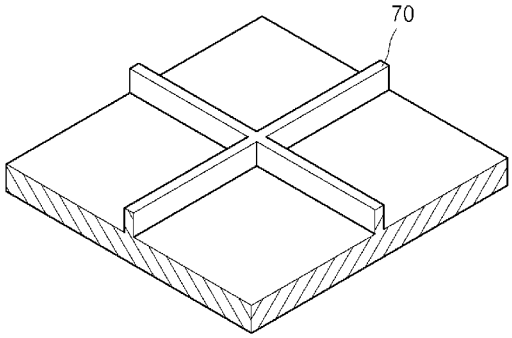

FIGS. 6 and 7 are partially enlarged perspective views of a frame member of block decks according to other embodiments of the present invention.

FIG. 6 shows projections 60 provided in the form of dots, and FIG. 7 shows projections 70 provided in the form of straight ribs.

As shown therein, the projections are formed on the inner surface of the frame member to increase adhesion between the filler 200 (see FIG. 1) and the frame member 100. Since the filler 200 fills the hollow portion 102 in a foamed state inside the frame member 100, the projections 60 or 70 in the hollow portion in the frame member 100 increase adhesion between the frame member and the filler.

Although some embodiments have been described with reference to the accompanying drawings, the present invention may be embodied in many different ways and should not be construed as being limited to the embodiments set forth herein. It will be understood by those skilled in the art that various modifications, changes, alterations, and equivalent embodiments can be made without departing from the spirit and scope of the invention. Therefore, it should be appreciated that the foregoing embodiments are provided for illustrative purposes only and are not to be construed in any way as limiting the present invention.

The invention claimed is:

1. A block deck, comprising:

a frame member having a hollow portion therein; and a filler made of concrete and filling the hollow portion, wherein the frame member includes a plurality of projections protruding towards the hollow portion, the projections are in the form of dots, the frame member includes an external surface formed with at least one of an embossed pattern and an engraved pattern, the frame member includes an upper frame member and a lower frame member which are assembled by slide-fitting, the upper frame member includes a first partition wall and two first side walls, the lower frame member includes a second partition wall and two second side walls, each of the first and second partition walls and first and second side walls includes a fitting projection and a fitting groove, the fitting projection and fitting groove of the first partition wall are respectively slide-fitted to the fitting groove and fitting projection of the second partition wall, and the fitting projection and fitting groove of each of the first side walls are respectively slide-fitted to the fitting groove and fitting projection of a corresponding one of the second side walls.

2. The block deck according to claim 1, wherein the concrete has a foaming rate of 0~50%.

3. The block deck according to claim 1, wherein the frame member comprises a material selected from the group consisting of natural wood, synthetic wood, and synthetic resin.

4. The block deck according to claim 1, wherein the frame member is made of synthetic wood, and the synthetic wood is formed by mixing, melting and extruding wooden flour or rice husks with a plastic material at high temperature, the plastic material being selected from among polyolefin, polypropylene, acrylonitrile butadiene styrene (ABS), and polyvinylchloride (PVC).

5. The block deck according to claim 1, wherein the frame member has a thickness of 4 mm to 8 mm.

6. A block deck, comprising:

a frame member having a hollow portion therein and made of a synthetic resin;

an external sheet made of natural wood or synthetic wood and attached to one side of the frame member; and a filler made of foamed concrete and filling the hollow portion, wherein the frame member comprises a plurality of projections protruding towards the hollow portion, the projections are in the form of dots, and the external sheet is formed with at least one of an embossed pattern and an engraved pattern, the frame member includes an upper frame member and a lower frame member which are assembled by slide-fitting, the upper frame member includes a first partition wall and two first side walls, the lower frame member includes a second partition wall and two second side walls, each of the first and second partition walls and first and second side walls includes a fitting projection and a fitting groove, the fitting projection and fitting groove of the first partition wall are respectively slide-fitted to the fitting groove and fitting projection of the second partition wall, and the fitting projection and fitting groove of each of the first side walls are respectively slide-fitted to the fitting groove and fitting projection of a corresponding one of the second side walls.

7. The block deck according to claim 6, wherein the concrete has a foaming rate of 0~50%.

8. The block deck according to claim 6, wherein the frame member has a thickness of 4 mm to 8 mm.

9. The block deck according to claim 1, wherein the frame member includes the plurality of projections on each of inner surfaces of the frame member.

10. The block deck according to claim 6, wherein the frame member includes the plurality of projections on each of inner surfaces of the frame member.

* * * * *